United States Patent [19]

Nobayashi

[11] Patent Number: 4,744,325

[45] Date of Patent: May 17, 1988

[54] ENGINE COMPARTMENT AND STEERING ARRANGEMENT LAYOUT FOR A SMALL WATERCRAFT

[75] Inventor: Noboru Nobayashi, Kosai, Japan

[73] Assignee: Yamaha Hatsudoki Kabushiki Kaisha, Iwata, Japan

[21] Appl. No.: 934,728

[22] Filed: Nov. 25, 1986

[30] Foreign Application Priority Data

Nov. 26, 1985 [JP] Japan ..... 60-265890

[51] Int. Cl.[4] ..... B63B 35/86

[52] U.S. Cl. ..... 114/270; 114/144 R

[58] Field of Search ..... 114/270, 363, 343, 360, 114/144 R, 201 R, 203; 440/38, 40, 42, 47, 76, 77; 441/74, 72, 65; D12/307, 312, 314, 317, 318, 173, 174, 175, 178; 180/190, 69.21, 78, 334; 74/493

[56] References Cited

U.S. PATENT DOCUMENTS 3,826,220 7/1974 Jacobson ..... 114/270

4,641,599 2/1987 Thomas et al. ..... 114/270 X

FOREIGN PATENT DOCUMENTS 940388 1/1974 Canada ..... 114/270

*Primary Examiner*—Galen Barefoot

*Assistant Examiner*—Paul E. Salmon

*Attorney, Agent, or Firm*—Ernest A. Beutler

[57] ABSTRACT

An improved steering arrangement for a small watercraft wherein the steering device is supported on a rigid supported mast that extends upwardly and forwardly over the engine and hatch cover for ease of access. The mast is also buoyant so that the watercraft cannot become accidentally inverted.

8 Claims, 4 Drawing Sheets

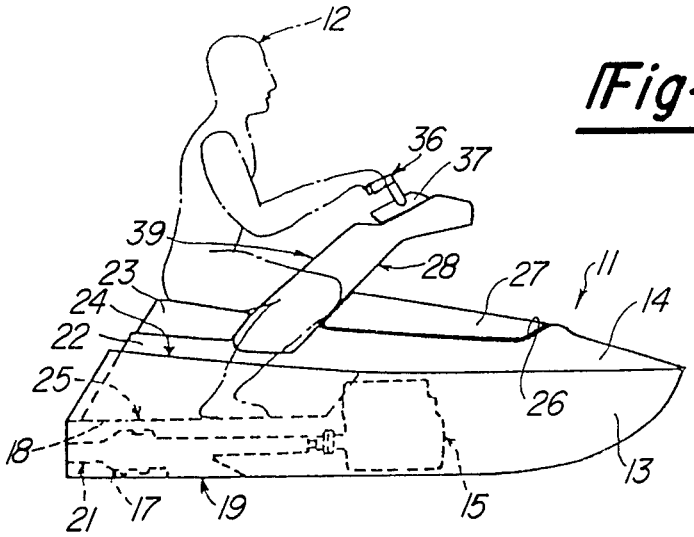
Fig-2
Fig-3
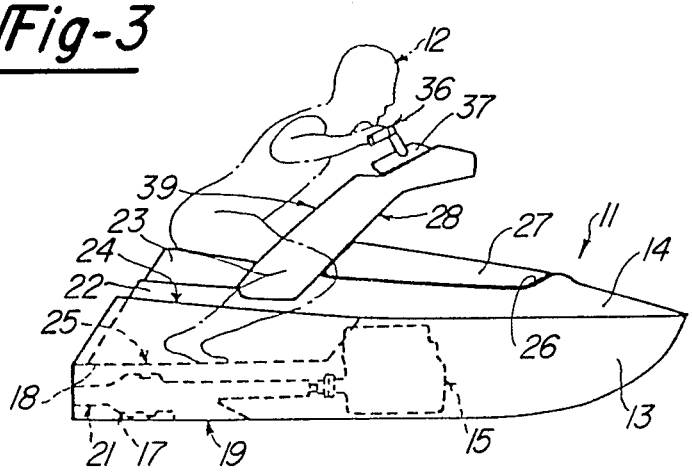

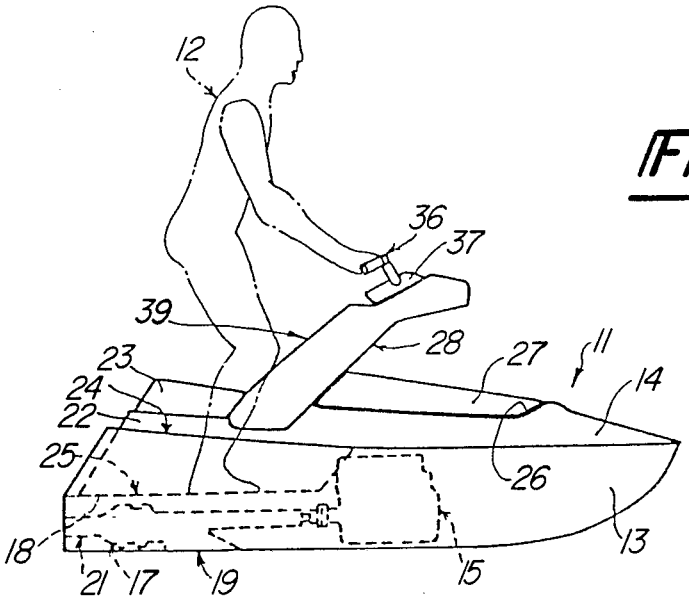
Fig-4
Fig-6
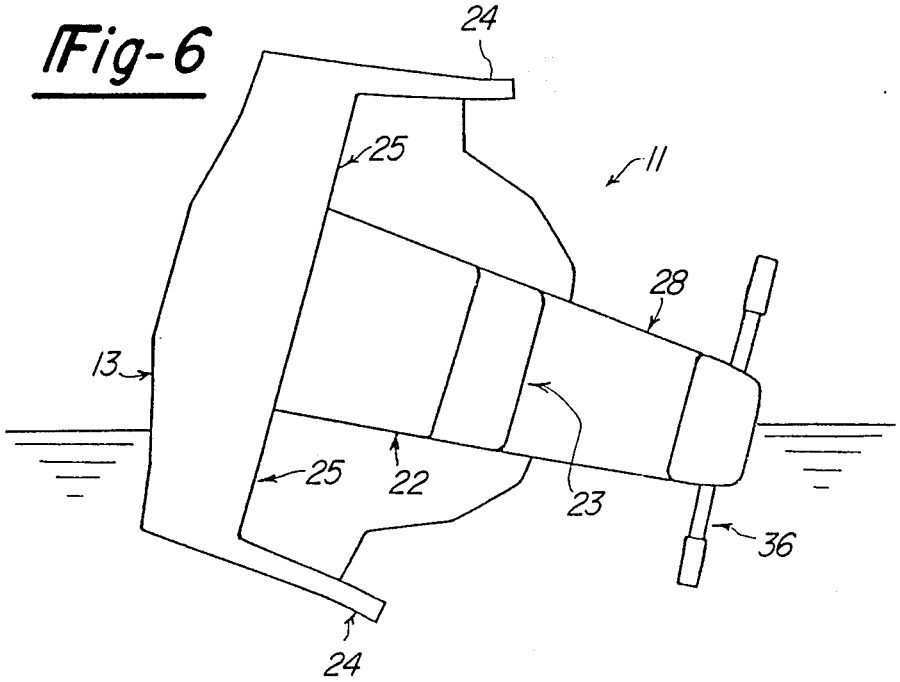

ENGINE COMPARTMENT AND STEERING ARRANGEMENT LAYOUT FOR A SMALL WATERCRAFT

BACKGROUND OF THE INVENTION

This invention relates to a small boat and more particularly to an improved steering mechanism and support therefor for such a watercraft.

A type of boat that has experienced much recent popularity is a small watercraft that is designed primarily to accomodate a single rider and which is powered by a jet drive. These boats fall into two general types, the first of which accomodate the rider in a standing fashion and thus approximate a powered surfboard and the second in which the rider is primarily seated during the watercraft operation. Each type of boat has its following and these boats have been designed so that either of them can be ridden in the other fashion. That is, some of the surfboard type boats may be ridden with the rider in a seated position and some of the more conventional type may be operated with the rider in a standing position. In order to accomodate this variation in riding position it has been proposed to provide a pivoted handle that supports the steering mechanism. Such pivoted handles, however, complicate the structure and give rise to inaccessability of certain of the other components. Even with the type of watercraft that is designed to be ridden in a seated position, the mounting for the steering mechanism can interfere with the accessability of some of the mechanical components.

For balance with this type of watercraft, it has been the practice to position the engine forwardly in the watercraft and have the rider's area located at a rear location. Because of this, the steering mechanism tends to lie over the engine compartment and thus it is difficult with the prior art type of constructions to afford access to the engine compartment.

This type of watercraft also is highly maneuverable and, as such, there is always the likelihood that the rider may be displaced from the watercraft. Certain of the boats of this type have been designed so as to accomodate such displacement of the rider either through self-righting, automatic engine killing or the like. However, it is important to ensure that the watercraft will be easy for the rider to right when he wants to re-enter the watercraft after being displaced from it.

It is, therefore, a principal object of this invention to provide an improved small boat.

It is a further object of this invention to provide a small boat with a mechanism which permits steering from any of a plurality of riding positions.

It is a further object of this invention to provide a steering mechanism for a small boat of this type that does not interfere with the access to the engine compartment.

It is yet another object of this invention to provide an arrangement for a small boat wherein the stability of the boat and the ability return it to an upright position if it becomes capsized is facilitated.

SUMMARY OF THE INVENTION

This invention is adapted to be embodied in a small watercraft having a hull defining a forewardly disposed engine compartment and a rearwardly disposed rider's area. A mast is carried by the hull in juxtappostion to the rider's area and extends upwardly and forwardly. A steering device is carried at the upper end of the mast.

In accordance with one feature of the invention, the mast is rigidly affixed relative to the watercraft and is buoyant so that the watercraft cannot become inverted accidentally.

BRIEF DESCRIPTION OF THE DRAWINGS

FIG. 2 is a reduced scale side elevational view showing one of the rider positions possible with this watercraft.

FIG. 3 is a side elevational view, in part similar to FIG. 2, showing another riding position.

FIG. 4 is a side elevational view, in part similar to FIGS. 2 and 3, showing still another riding position.

FIG. 6 is an end elevational view showing how the mast prevents the watercraft from becoming inverted.

DETAILED DESCRIPTION OF THE PREFERRED EMBODIMENT OF THE INVENTION

Figure 1:
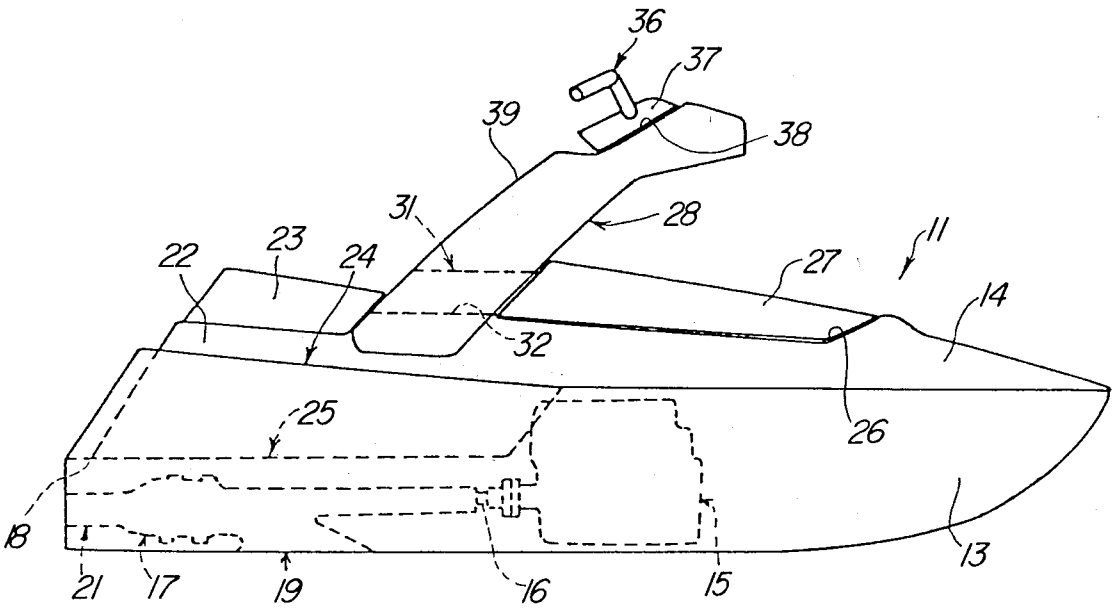
FIG. 1 is a side elevational view of a watercraft constructed in accordance with an embodiment of the invention.

In the drawings the reference numeral 11 indicates generally a small watercraft constructed in accordance with the invention. The watercraft 11 is designed primarily for use by a single rider, shown in some of the figures in phantom and identified by the reference numeral 12.

The watercraft 11 is comprised of a hull 13 to which a deck 14 is affixed in a suitable manner. Contained with the hull 13 substantially at its longitudinal center line is a powering internal combustion engine 15. The engine 15 has its output shaft 16 coupled to an impeller of a jet drive unit, indicated generally by the reference numeral 17, for powering the watercraft 11. The jet drive unit 17 is postioned within a tunnel 18 formed in the base of the hull 13 and which forms with the jet drive unit 17 a water inlet opening 19 through which water is drawn for propelling the watercraft 11. The water is discharged through a pivotally supported discharge nozzle 21 and pivotal movement of the discharge nozzle is employed for steering the watercraft as is well known in this art.

To the rear of the watercraft 11, the deck 14 is provided with a raised center portion 22 on which is mounted cushioned seat 23 for accomodating the rider 12, as will be further described. On opposite sides of the raised portion 22, the hull 13 is provided with a pair of raised gunnels 24 that define an area 25 on opposite sides thereof for accomodating the rider's feet.

Forewardly of the raised portion 22, the deck 14 is provided with an opening 26 that overlies the engine 15 and other internal components of the watercraft 11. The opening 26 is closed by a removable hatch 27 so as to offer access to the engine 15 and these other components for servicing.

The general configuration of the watercraft 11 as thus far described may be considered to be conventional. However, with conventional watercraft the positioning and operation of the mechanism for steering the discharge nozzle 21 of the water jet has enchroached upon the area where the hatch 27 is located and has either compromised the location and operation of the hatch 27 or, alternatively, has compromised the steering mechanism. In accordance with this invention, an improved construction is provided for mounting the steering mechanism which permits the operator or rider 12 to steer the watercraft 11 from any of a plurality of positions in a comfortable fashion and without upsetting the balance of the watercraft. In addition, the steering mounting is designed in such a way so as to provide a flotation device so as to prevent inversion of the watercraft 11 in the event that the watercraft 11 is capsized.

The steering mounting and flotation mechanism comprises a mast, indicated generally by the reference numeral 28 which is affixed in a manner to be described to the deck 14. The mast 28 may, like the deck 14 and hull 13, be formed from a fiberglass reinforced plastic and has a generally open, box-shape configuration as clearly shown in FIG. 5 wherein the hollow opening of the mast 28 is indicated generally by the reference numeral 29. This area 29 is sealed by means of an upper bulkhead 31. The area 29 may be merely filled with air or, alternatively, may be filled with a foamed plastic or the like to maintain good flotation. It should be noted that the mast 28 extends upwardly and forwardly from the area above to the front of the seat cushion 23 and terminates above the hatch opening 26 but at a substantial distance above it so as to not interfere with the opening or closing of the hatch 27 nor to interfere with the access to the components located beneath it so that they may be easily serviced.

As may be readily seen from an inspection of FIG. 6, if the watercraft 11 is capsized, the length, rigidity and buoyancy of the mast 28 will be effective to preclude complete inversion of the watercraft 11. Thus, some of the disadvantages present with watercrafts of the type that may be completely inverted but nevertheless are self-righted are avoided with this design.

Figure 5:
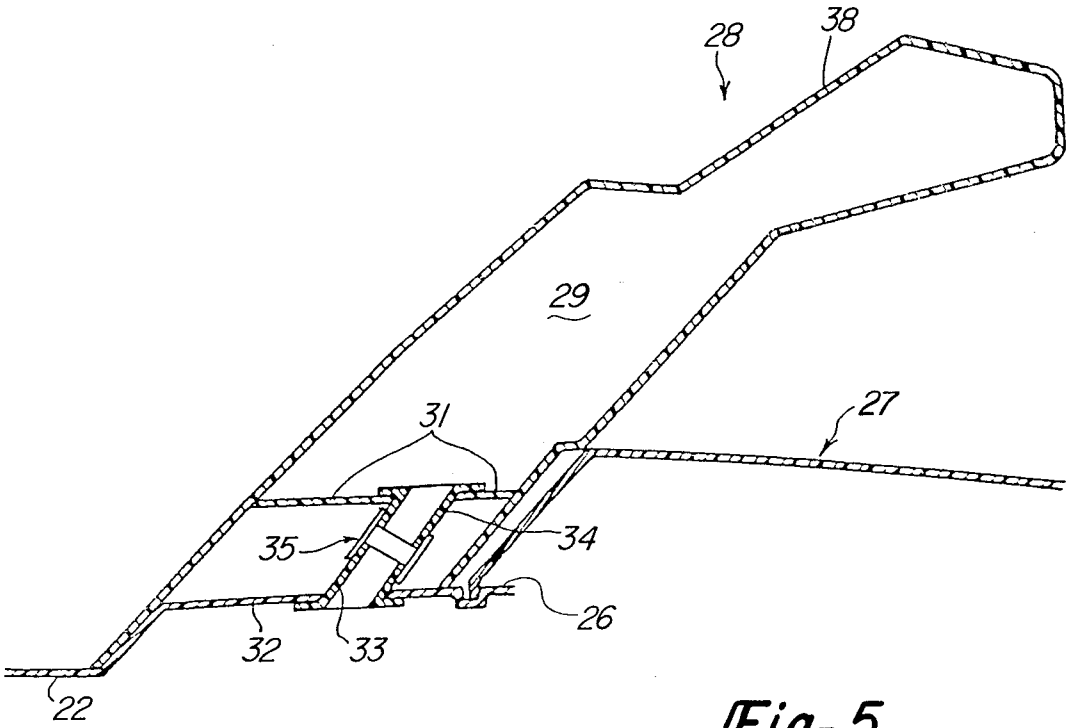
FIG. 5 is an enlarged cross-sectional view showing the mast for supporting the steering mechanism.

As may be seen in FIG. 5, the deck 22 is provided with a raised portion 32 that is generally complementary in shape to an opening formed at the lower end of the mast 28 below the bulkhead 31. A first pipe section 33 is flanged and is affixed to this raised deck portion. In a similar manner, a second pipe section 34 is flanged and is affixed to the bulkhead 31 and extends downwardly and in aligned relationship with the pipe section 33. The pipe sections 33 and 34 are connected to each other by means of a coupling pipe section 35 and thus the mast 28 is rigidly affixed to the deck 22 through the pipe sections 33 and 34 and coupling pipe section 35.

The pipe sections 33, 34 and 35 define a tubular area that is adapted to pass a cable for a steering mechanism. The upper end of this cable is affixed to a drum that is carried by the lower end of a steering handlebar 36 in a known manner. The handlebar 36 is journaled by a supporting bracket 37 that is affixed to a recess 38 formed in the upper end of the mast 28. A curved rearwardly facing portion 39 of the mast depends from the recessed area 38.

As may be readily seen from the figures and specifically from FIG. 2, the design is such that a rider seated on the seat 23 may conveniently steer the watercraft through the handlebars 36. It should be noted that in the seated position, the handlebars lie at approximately shoulder height of a rider who is sitting in an erect position. The seated rider may also lean forwardly and, if desired, rest his weight on the curved mast portion 39 as partially shown in FIG. 3. This position may be assumed to permit high speed or certain maneuvering operation. Furthermore, the elevation position of the handlebars 36 permit a rider to steer the watercraft from a standing operating position (FIG. 4). Therefore, it should be readily apparent that steering may be easily accomplished from any of the variety of riding positions which the rider may assume.

It should be readily apparent from the foregoing description that the illustrated and described watercraft has an arrangement for mounting the steering mechanism which permits the rider to select any of a plurality of riding positions each of which is comfortable and affords good balance for the watercraft. In addition, the location of the supporting mast is such that it does not interfere with access to the centrally positioned engine compartment and, furthermore, the construction and buoyancy of the mast prevents inversion of the watercraft even if it capsizes.

Although an embodiment of the invention has been illustrated and described, various changes and modifications may be made without departing the spirit and scope of the invention, as defined by the appended claims.

I claim:

1. In a small watercraft, a hull defining a forwardly disposed enclosed engine compartment and a rearwardly disposed rider's area, a fixed mast carried by said hull in juxtaposition to said rider's area, an engine in said hull forwardly of said rider's area, an access opening in an upper surface of said hull for access to said engine forwardly of said mast, a removable cover closing said access opening, and a steering device journaled at the upper end of said mast and moveable relative to said mast for steering said watercraft, said mast extending upwardly and forwardly from said rider's area over the engine and removable cover in fixed condition to said hull.

2. In a small watercraft as set forth in claim 1 wherein the mast is spaced a substantial distance above the access opening.

3. In a small watercraft as set forth in claim 2 wherein the rider's area further includes a seat positioned to the rear of the mast.

4. In a small watercraft as set forth in claim 3 wherein the rider is able to steer the watercraft while seated on the seat and may lean forward and rest his weight upon the mast or may stand and steer the watercraft from a standing position.

5. In a small watercraft as set forth in claim 4 wherein the mast is buoyant for preventing inversion of the watercraft upon capsizing.

6. In a small watercraft as set forth in claim 1 wherein the mast is buoyant for preventing inversion of the watercraft upon capsizing.

7. In a small watercraft as set forth in claim 6 wherein the mast is spaced a substantial distance above the access opening.

8. In a small watercraft as set forth in claim 7 wherein the rider is able to steer the watercraft while seated and may lean foreward and rest his weight upon the mast or may stand and steer the watercraft from a standing position.

* * * * *

UNITED STATES PATENT AND TRADEMARK OFFICE

CERTIFICATE OF CORRECTION

PATENT NO. : 4,744,325

DATED : May 17, 1988

INVENTOR(S) : Noboru Kobayashi

It is certified that error appears in the above-identified patent and that said Letters Patent is hereby corrected as shown below:

On the title page inventor's last name should read -- Kobayashi --.

Signed and Sealed this

Thirteenth Day of September, 1988

*Attest:*

DONALD J. QUIGG

*Attesting Officer*

*Commissioner of Patents and Trademarks*